United States Patent [19]

Rannels

[11] 3,971,176

[45] July 27, 1976

[54] STUD-TRUSS AND METHOD OF MAKING SAME

[76] Inventor: Lynn Lee Rannels, R.D. 2, Reinholds, Pa. 17569

[22] Filed: Feb. 5, 1975

[21] Appl. No.: 547,332

[52] U.S. Cl. ..... 52/86; 52/63; 52/204; 52/644; 52/658; 52/720

[51] Int. Cl.[2] ..... E04B 1/32

[58] Field of Search ..... 52/86, 85, 63, 644, 52/631, 658, 204, 720; 144/309 B, 324

[56] References Cited

UNITED STATES PATENTS

| | | | |
|---|---|---|---|
| 1,800,988 | 4/1931 | Ewing | 52/644 |
| 2,181,164 | 11/1939 | Alexander | 52/631 |
| 2,827,138 | 3/1958 | Roy | 52/86 |
| 3,206,888 | 9/1965 | Litzka | 52/644 X |
| 3,260,022 | 7/1966 | Guyer et al. | 52/86 |
| 3,413,774 | 12/1968 | Oberreich | 52/720 |
| 3,706,173 | 12/1972 | Taylor | 52/716 |

*Primary Examiner*—Alfred C. Perham

[57] ABSTRACT

A permanently formed stud-truss includes a wood member having a curved length positioned between two substantially straight lengths. The curved length has a plurality of removed portions on the concave side thereof, at least a portion of the adjacent surfaces of which contact each other. The depth of the removed portions is greater than one-half the thickness of the wood member but at least ¼ inch less than the total thickness of the wood member. The stud-truss also includes means permanently maintaining at least the open ends of the adjacent surfaces of each of the removed portions in contact. A method of making the stud-truss and of constructing a small modular building utilizing the stud-truss is also disclosed.

3 Claims, 7 Drawing Figures

STUD-TRUSS AND METHOD OF MAKING SAME

BACKGROUND OF THE INVENTION

This invention relates to a novel stud-truss for the construction of a small modular building, and is particularly concerned with a stud-truss which is formed in a permanent shape from a common wood structural member.

In prior small wooden buildings, studs are commonly used for the support of the vertical walls and trusses are commonly used for the support of the roof structure. The use of separate studs and separate trusses as well as wall plates and wall sills is not compatible with a low cost building which can be economically produced as a kit in an assembled form and generally require assembly by a skilled person.

SUMMARY OF THE INVENTION

A permanently formed stud-truss includes a wood member having a curved length positioned between two substantially straight lengths, the curved length having a plurality of removed portions in the concave side thereof, at least a portion of the adjacent surfaces of which contact each other, each of the removed portions having a depth greater than one-half the thickness of the wood member but at least about ¼ inch less than the total thickness thereof and means permanently maintaining at least the open ends of the adjacent surfaces of each of the removed portions substantially in contact. The novel stud-truss is a one-piece permanent unit. It is formed of commonly available wood structural members resulting in a very low unit cost. These low cost units can be easily transported to the site and assembled into a modular building by unskilled persons. Since the stud-truss is a wood member, it can be easily assembled with nails and staples can be used to fasten the covering material. The stud-truss is specially useable in a small modular greenhouse which can be sized to meet the needs and budget of the user. The modular greenhouse is specially desireable to extend the growing season in cooler climates to permit the economical production of home grown vegetables.

The method of making a permanent wood stud-truss having a curved length positioned between two substantially straight lengths includes the steps of selecting a wood member, removing a plurality of spaced portions of the wood member in the curved length, each of the removed portions having a depth greater than one-half the thickness of the wood member but at least about ¼ inch less than the total thickness thereof, bending the wood member until at least a portion of the adjacent surfaces of said removed portions contact each other, and then permanently fixing said stud-truss in said bent form. The novel method provides a single permanent stud-truss which can be used to make a small modular building. The novel method also permits construction of the stud-truss with unskilled persons in an economical manner.

DESCRIPTION OF THE PREFERRED EMBODIMENTS

Stud-truss

Figure 1:
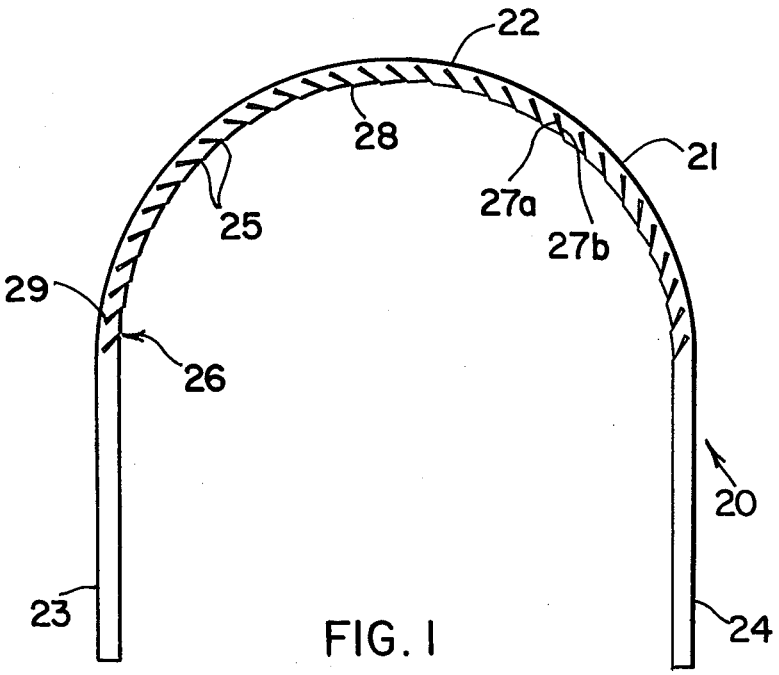
FIG. 1 illustrates an end elevational view of the stud-truss of the invention.

FIG. 1 illustrates the preferred embodiment of the novel stud-truss 20. A stud-truss 20 is a permanently shaped unit which combines the vertical support members used in building structures commonly called studs and the horizontal roof support structure commonly called a truss. In the preferred embodiment illustrated in FIG. 1, the stud-truss 20 is formed of a wood member 21 having a curved length 22 positioned between a first and a second substantially straight length 23 and 24 respectively.

The curved length 22 has a plurality of removed portions 25 on the concave side thereof. The shape, spacing, depth, and other paramenters of the removed portions 25 will be described later in detail.

The stud-truss 20 also includes clamping means 26 permanently maintaining the adjacent surfaces **27*a* and 27*b* of each of the removed portions 25 substantially in contact at least at the open end 28 thereof to permanently retain the stud-truss 20 in the desired form. In the preferred embodiment, the clamping means 26 permanently maintaining the adjacent surfaces 27*a* and 27*b* of each of the removed portions 25 substantially in contact against each other is a hardened adhesive material 29 positioned between each of the adjacent surfaces 27*a* and 27*b***.

Figure 2:
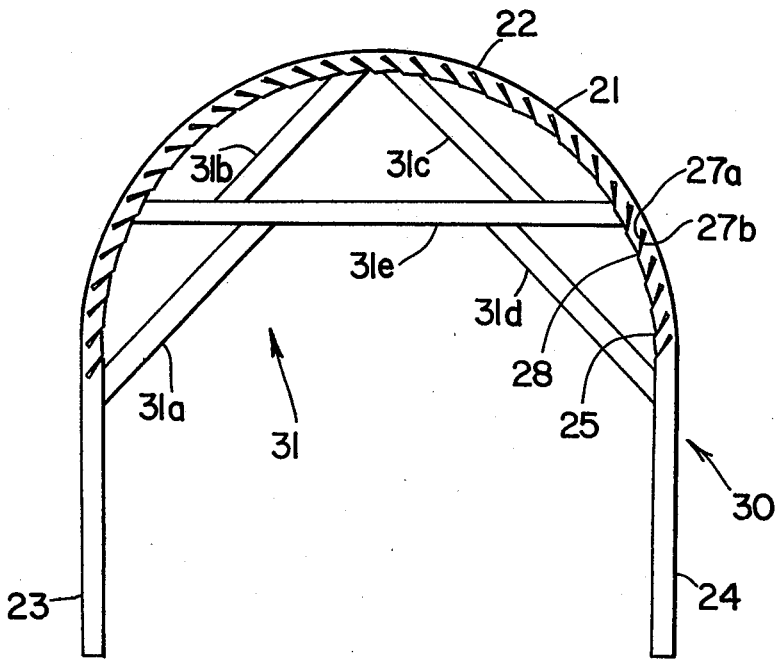
FIG. 2 illustrates an end elevational view of an alternative embodiment of the stud-truss illustrated in FIG. 1.

In an alternative embodiment of a stud-truss 30 illustrated in FIG. 2, the clamping means 26 permanently maintaining the adjacent surfaces **27*a* and 27*b* of each of the removed portions 25 substantially in contact at least at the open end 28 thereof includes tie means 31 between the curved length 22 and the first and second straight lengths 23 and 24. Surprisingly, the combination of the removed portions 25 having adjacent contacting surfaces 27*a* and 27*b* and the tie means 31 provide a stud-truss 30 which retains its form without an adhesive between the adjacent surfaces 27*a* and 27*b***.

Method of Making Stud-Truss

Figure 3:
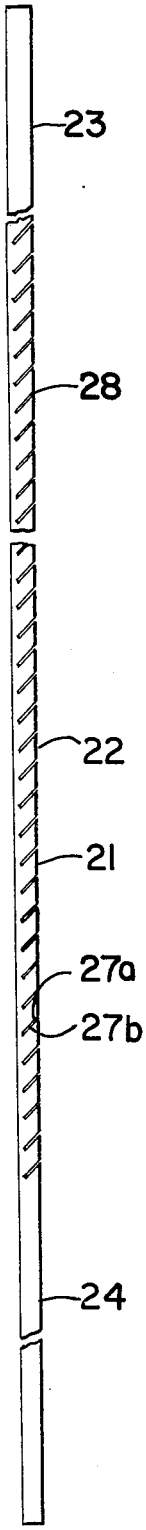
FIG. 3 illustrates the wood member used in the stud-truss illustrated in FIGS. 1 and 2.
Figure 7:
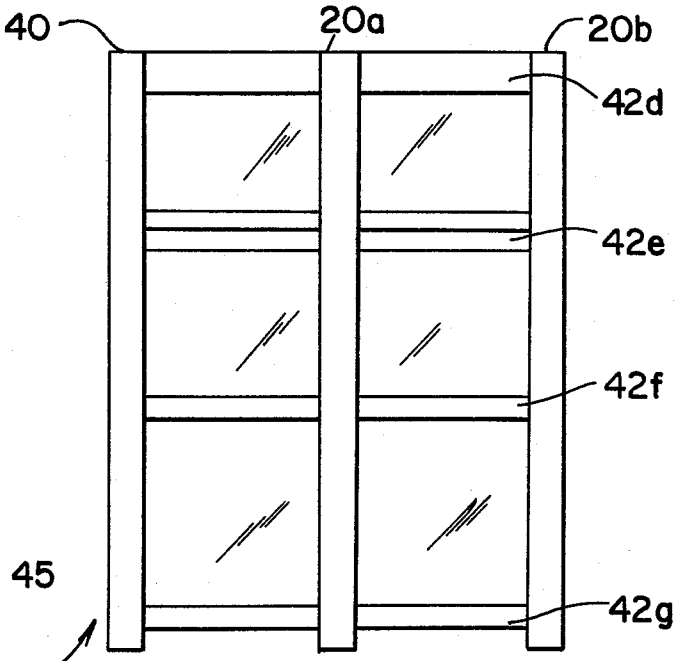
FIG. 7 illustrates a side elevational view of the novel building structure illustrated in FIG. 6.
Figure 6:
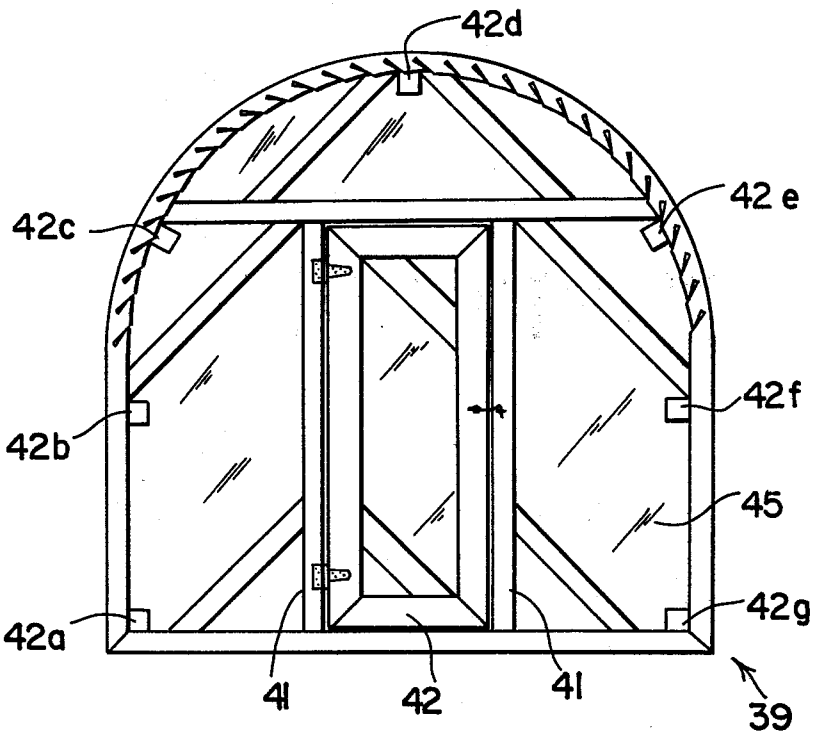
FIG. 6 illustrates an end elevational view of a building structure utilizing the novel stud-truss illustrated in FIGS. 1 and 2.

It is preferred that the novel stud trusses 20 or 30 be made with a one-piece wood member 21 as illustrated in FIG. 3. Where the novel stud-truss 20 or 30 is used to make a novel small economical modular greenhouse, such as illustrated in FIGS. 6 and 7, the wood member 21 is a 2 inch by 4 inch by 20 feet long piece of wood. Although it is preferred that the wood member 21 is a one-piece member, if a larger stud-truss 20 or 30 is desired, splicing of at least two pieces may be necessary because of the commercial unavailability of a 2 inch by 4 inch piece of wood longer than 20 feet. A bevel splice or other splice can be used.

In making a permanent stud-truss 20 or 30 as illustrated in FIGS. 1 and 2, a wood member 21 is first selected. The wood member 21 must not be kiln dried, that is, it must be what is commonly referred to as green. The wood member 21 may be formed of a commercially available wood such as fir, pine, or spruce. Since the wood member 21 is bent to form the novel stud-truss 20 or 30, it is preferrable that the wood member 21 be as free as possible from knots or at least contain only small tight knots.

The wood member 21 is first dipped in a cold creosote for preservation. The wood member 21 must not be pressure treated because if it is used in a greenhouse, the heat therein may cause the creosote to vaporize and damage the growing vegetation.

After the particular wood member 21 is preserved, it is inspected to determine which 4 inch face contains most of the latest growth. Then a plurality of portions 25 of the curved length 22 are removed to permit bending the curved length 22. It is preferred that the plurality of removed portions 25 are removed from the face opposite that of the latest growth since this face is the most flexible for use as the convex or outer side of the curved length 22. In the preferred embodiment, the removed portions 25 are spaced cuts 32 in the concave surface of the curved length 22 as better illustrated in FIG. 4.

The amount of curvature of the curved length 22 is determined by a combination of the space 34 between the cuts 32 and the width 35 of each of the cuts 32. The ability to form a smooth continuous curvature without splitting the wood member 21 at any of the cuts 32 is determined by the depth 36 of the cuts 32, the uncut edge depth 37 of the wood member 21 remaining, and the angle 38 at which the cuts 32 are formed in the wood member 21.

Figure 5:
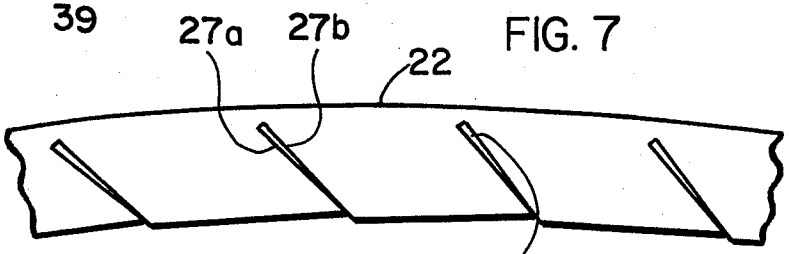
FIG. 5 illustrates an enlarged broken away view of a portion of the wood member illustrated in FIG. 4 after it is formed into the curved length of the stud-truss illustrated in FIGS. 1 and 2.

Referring to FIG. 5, it is readily observable that at least the open end 28 of the cuts 32 is closed in substantially tight contact for all of the cuts 32 in the curved length 22. When the open end 28 of the cuts 32 are closed for all of the cuts 32, the curvature of the curved length 22 is established. Once the cuts 32 are closed, further bending is not possible without splitting the wood member 21.

To form a smooth continuous curve in the curved length 22, the cuts 32 must be substantially equally spaced and parallel over the total length of the curved length 22. The preferred spacing between the cuts 32 is in the range of 2 inches to 4 inches. In the preferred embodiment the space 34 is about 2 and ½ inches.

It is also preferred that the cuts 32 are of a depth 36 greater than one-half the thickness of the wood member 21, but about ¼ inch less than the total thickness of the wood member 21. Where the wood member 21 is 2 inches thick by 4 inches wide (actually 1 ⅝ inch thick by 3 ⅝ inches wide) the preferred depth 36 of the cut 32 is 1 ⅛ inch. This retains ¼ inch (measured normal to the surface of the wood member 21) uncut edge of the wood member 21.

Figure 4:
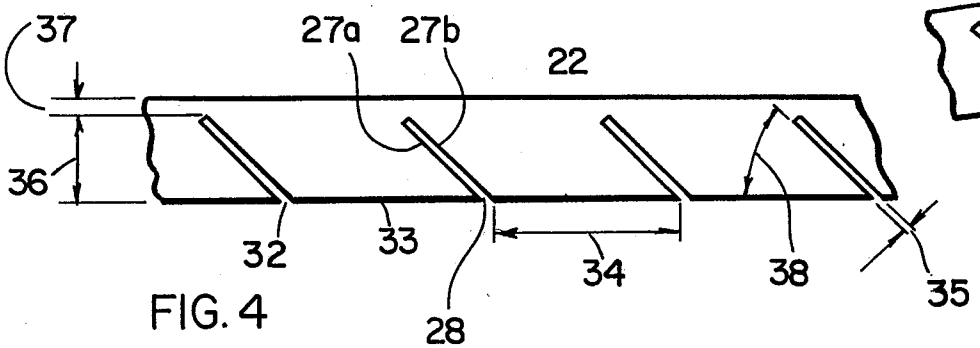
FIG. 4 illustrates an enlarged broken away view of a portion of the wood member illustrated in FIG. 3.

The preferred width 35 of the cuts 32 is in the range of 3/32 inch to 3/16 inch wide. In the preferred embodiment the cuts 32 are about ⅛ inch wide. It is preferred that the cuts are rectangular in shape such as formed by a circular saw. This forms a flat bottom as shown in FIGS. 3 and 4. The flat bottom is helpful in bending the wood member 21 to form the curved length 22.

The cuts are preferrably formed on an angle 38 with the surface of the wood member 21. The preferred angle is in the range of 30° to 80°. In the preferred embodiment, the angle 38 is about 45°. The preferred embodiments of the stud-trusses 20 and 30 are better described in the following examples.

EXAMPLE 1:

The stud-truss 20 shown in FIG. 1 is fabricated from a standard nominal 2 inch by 4 inch by 20 feet long piece of wood. The curved length 21 is approximately 11 feet 2 inches long substantially centered on the wood member 21. The width 35 of the cuts 32 is about ⅛ inch and the angle 38 is about 45°. The depth 36 of the cuts 32 is such that an uncut edge depth 37 of ¼ inch of uncut wood member 21 is retained within the curved length 22. The space 34 is about 2 ½ inches.

The wood member 21 is then bent to form the curved length 22 with the cuts 32 having surfaces **27*a* and 27*b* adjacent each other. The wood member 21 is bent by use of a forming fixture (not shown). The forming fixture comprises a table-like surface or platform having a member attached thereto having the shape of the outer surface of the stud-truss 20**.

In positioning the wood member 21 in the fixture, the wood member 21 is grasped near the center of the curved length 22. Immediately, because of the cuts 32, the curved length 22 starts to bend. It is then positioned with one end within the fixture and bent to conform to the fixture wall. Because of the angular shape of the cuts 32, it is believed that the stress concentration is uniformly distributed during bending. This prevents splitting during bending and provides for a smooth continuous curvature.

The stud-truss 20 is then permanently fixed in the bent form by positioning a liquid adhesive material within each of the cuts 32 prior to bending the wood member 21. The liquid adhesive material is allowed to flow within the cuts 32 as illustrated in FIG. 4 prior to positioning the wood member 21 within the forming fixture. It is preferred that the liquid adhesive material be a thermoplastic material. One suitable material is a hot melt thermoplastic material. Other waterproof adhesives or epoxys may also be used. It is preferable that the adhesive material be quick setting to permit almost an immediate removal of the stud-truss 20 from the forming fixture.

After the adhesive material is within the removed portions 25 the wood member 21 is positioned in the forming fixture. The adhesive material is then allowed to harden to permanently fix the stud-truss 20 in the desired form.

Since in this embodiment the novel stud-truss 20 comprises a upside-down U shaped member, some spring back may occur after removal from the forming fixture. This is no problem since the forming fixture can be designed to overbend the wood member 21 to compensate for spring back.

EXAMPLE 2:

The wood member 21 of the stud-truss 30 is formed as described in Example 1. Then tie means 31 are attached between the curved length 22 and the straight lengths 23 and 24 to form the permanent stud-truss 30. The preferred tie means 31 are tie members **31*a* through 31*e* shown in FIG. 2. The combination of the tie members 31*a* through 31*e* and the closed cuts 32 forms the permanent stud-truss 30**.

Building

The novel stud trusses 20 and 30 previously described may be used to construct a small modular building as illustrated in FIGS. 6 and 7. The preferred use of the novel stud-trusses 20 and 30 is to construct a small modular greenhouse which is of sufficient size for a home gardner. The stud-trusses are particularly useful for this type building since the modular concept provides a building size suitable to each persons particular needs. The novel stud-truss 20 and 30 also permit fast and economical construction of a modular building either in a factory type production line or as a kit by the user.

The novel modular building includes at least two permanently formed stud-trusses, at least one longitudinal member attached to each of the stud-trusses, and a covering attached over the exterior of the spaced stud-trusses.

The building can be formed with entry means to prevent entry or one end thereof can be positioned against a door exit of an adjacent building. One suitable entry means is a flap of the covering (not shown) which can be easily attached and detached. Another suitable entry means utilizes a special stud-truss which includes a framed doorway and a door mounted therein. The door is preassembled on hinges within the doorway and is also covered with the covering material. When the building is constructed in a production line and transported to the site as a complete building, the building also includes sills and skids.

In the preferred embodiment illustrated in FIGS. 6 and 7, the building 39 includes a first stud-truss 40 having a framed doorway 41 and a door 42, a second stud-truss 20*a*, and a third stud-truss 20*b*. The first, second, and third stud-trusses 40, 20*a*, and 20*b* are spaced about three feet apart and are attached to longitudinal members 43*a* through 43*g*. The longitudinal members 43*a* through 43*g* each have a plurality of cut-outs therein to accurately space and engage over each of the stud-trusses. Nails or the hardened adhesive materials previously disclosed attach the longitudinal members and the stud-trusses. The building 39 also includes skids 44*a* through 44*c*.

The building 39 also includes a covering 45. In the preferred embodiment where the building is a greenhouse, the covering 45 is a transparent plastic. It is preferred that the plastic covering 45 is a polyethylene sheet which contains a woven nylon mesh therein for reinforcement.

Method of Constructing Building

In the construction of the modular building, at least two of the novel stud-trusses are provided. Then the stud-trusses are spaced as previously disclosed and attached to at least one longitudinal member. Then a covering is applied to the exterior of the spaced stud-trusses to form an enclosure therein.

In the construction of the preferred embodiment of the building 39, illustrated in FIGS. 6 and 7, a first stud-truss 40, a second stud-truss 20*a*, and a third stud-truss 20*b* are spaced and attached with longitudinal members 43*a* through 43*g*. The longitudinal members 43*a* through 43*g* are attached as previously disclosed. After the stud-trusses and the longitudinal members are assembled, the covering 45 is applied to the exterior of the building 39. It is preferred that the covering 45 be applied directy to the exterior surface of the stud-trusses and the longitudinal members with metal staples as well as to the end surface of the end stud-trusses. The nylon reinforcement in the covering prevents tearing at the staple attachment points.

Although the preferred building is a greenhouse, the building may also be an utility shed or garage. Other coverings such as ¼ inch waterproof plywood, or sheets of aluminum or fiberglass may also be used.

I claim:

1. A permanently formed stud-truss comprising a. a wood member having a curved length positioned between two substantially straight lengths, said curved length having a plurality of substantially parallel cuts on the concave side thereof at least a portion of the adjacent surfaces of which are in contact, each of said cuts having a depth greater than one-half the thickness of said wood member but at least about one-quarter inch less than the total thickness thereof, said cuts being all inclined in the same direction at about an included angle of 30° to 80° with the longitudinal axis of said wood member prior to the formation of said curved length, said angle being measured on the wood member surface containing partial cuts, and b. a hardened adhesive material between each of said adjacent surfaces permanently maintaining at least the open ends of the adjacent surfaces of each of said cuts substantially in contact whereby said stud-truss permanently retains a desired form.

2. A modular building comprising a. at least two permanently formed stud-trusses including a wood member having a curved length positioned between two substantially straight lengths, said curved length having a plurality of spaced parallel cuts on the concave side thereof, the adjacent surfaces of which are against each other, each of said cuts having a depth greater than one-half the thickness of said wood member but at least about ¼ inch less than the total thickness thereof, said spaced parallel cuts all inclined in the same direction and formed at an included angle of about 30° to 80° with the longitudinal axis of said wood member prior to the formation of the curved portion, said angle being measured on the wood member surface containing the parallel cuts and means permanently maintaining the adjacent surfaces of said removed portions substantially against each other, b. at least one longitudinal member attached to each of said plurality of trusses, c. and a covering attached over the exterior of said spaced stud-trusses whereby an enclosure is formed.

3. The structure defined in claim 2 wherein at least one of said stud-trusses includes entry means therethrough for entering said building.

* * * * *